US006179201B1

(12) United States Patent
Chess

(10) Patent No.: US 6,179,201 B1
(45) Date of Patent: Jan. 30, 2001

(54) INTEGRATED CARD CONSTRUCTION

(75) Inventor: Stanley C. Chess, Goffstown, NH (US)

(73) Assignee: Moore U.S.A. Inc., Grand Island, NY (US)

( * ) Notice: Under 35 U.S.C. 154(b), the term of this patent shall be extended for 0 days.

(21) Appl. No.: 09/123,350

(22) Filed: Jul. 28, 1998

(51) Int. Cl.[7] ..... B65D 27/00
(52) U.S. Cl. ..... 229/92.1; 229/92.8
(58) Field of Search ..... 229/92.1, 92.3, 229/92.8

(56) References Cited

U.S. PATENT DOCUMENTS

| | | | | |
|---|---|---|---|---|
| 3,184,150 | | 5/1965 | Hubbard . | |
| 3,461,581 | | 8/1969 | Hoffmann . | |
| 3,475,247 | | 10/1969 | Freundlich . | |
| 4,397,417 | | 8/1983 | Carlson . | |
| 4,778,153 | * | 10/1988 | Bachman et al. | 229/92.8 X |
| 4,890,862 | | 1/1990 | Buchholz . | |
| 4,925,716 | | 5/1990 | Haas . | |
| 5,048,748 | | 9/1991 | Martin et al. . | |
| 5,096,229 | | 3/1992 | Carlson . | |
| 5,131,686 | | 7/1992 | Carlson . | |
| 5,173,080 | | 12/1992 | Longtin . | |
| 5,198,275 | | 3/1993 | Klein . | |
| 5,219,183 | | 6/1993 | McKillip . | |
| 5,427,832 | | 6/1995 | Longtin . | |
| 5,495,981 | * | 3/1996 | Warther | 229/92.3 X |
| 5,632,511 | | 5/1997 | Longtin et al. . | |
| 5,650,209 | | 7/1997 | Ramsburg et al. . | |
| 5,667,247 | | 9/1997 | Ramsburg et al. . | |
| 5,695,589 | | 12/1997 | German et al. . | |
| 5,705,243 | * | 1/1998 | Mehta et al. | 229/92.3 X |

* cited by examiner

*Primary Examiner*—Jes F. Pascua
(74) *Attorney, Agent, or Firm*—Nixon & Vanderhye P.C.

(57) ABSTRACT

A pressure seal mailer assembly compatible with non-impact printing techniques includes paper stock with at least three interconnected and foldable panels and pressure activated adhesive along plural edges thereof. There is at least one opening in one of the panels and a removable card located and releasably held within the opening. In addition, there is a laminate assembly applied to one side of the paper stock covering at least the opening therein, wherein part of the laminate assembly remains with the card after it is removed from the paper stock.

6 Claims, 3 Drawing Sheets

INTEGRATED CARD CONSTRUCTION

TECHNICAL FIELD

This invention relates to pressure seal mailers generally, and more specifically to the incorporation of a clean release card product into a pressure seal mailer.

BACKGROUND PRIOR ART

It is known to include ID or other card components within mailer constructions as disclosed, for example, in commonly owned U.S. Pat. No. 5,534,320. In that case, a discrete card is temporarily adhered to a layer of stock material which, in turn, is adhered to the carrier sheet which forms the mailer. In another commonly owned U.S. Pat. No. 5,650,209, a clean release card is incorporated in a "bang tail" type mailer.

Non-mailer printable sheets have also incorporated separable cards, as disclosed, for example, in U.S. Pat. No. 5,219,183.

SUMMARY OF THE INVENTION

This invention incorporates a known clean release card construction within a pressure seal mailer. By integrating the card (or cards) within a pressure seal mailer, the latter (including the card) can be printed in a non-impact printer, such as a laser printer, without concern for gumming up the printer as often occurs with heat activated adhesive mailers. In this regard, the card itself is preferably die-cut from the paper stock forming the mailer and does not add any appreciable thickness to the mailer. In accordance with the invention, the paper carrier stock can be top coated with a laser receptive plastic film, or left with a paper face, both of which accept printer toner. In addition, integrating the card within the mailer reduces customer labor by eliminating the folding and stuffing of cards or forms into an envelope.

In one exemplary embodiment of the invention, a commercially available laminate assembly is applied to a predetermined area on the underside of a pressure seal Z-fold (regular or eccentric) mailer in cut or continuous form. This laminate assembly is larger on all sides than the one or more cards to be die-cut from the opposite side of the form. The laminate assembly includes, from top to bottom, polyester film with an adhesive coating on its top surface and a base liner or backing patch top coated with, e.g., a varnish. As purchased, the adhesive film is protected by a disposable liner. This assembly is adhesively secured to the underside of the mailer, with the die cut(s) for the card(s) extending down through the paper stock of the mailer and through the polyester film of the laminate assembly. Even though die cut, however, the varnish provides a temporary and dry adherence of the card to the base liner or backing patch.

In another embodiment, a form as described above is modified to have an overlaminate applied over the card (i.e., on the side opposite that which has the backing patch. The overlaminate may comprise a laser and signature compatible polyester or other suitable film adhered to the top surface of the paper card and may extend over an area similar to that of the backing patch. It will be appreciated that neither the card (or cards), backing patch nor the overlaminate add any significant thickness to the mailer assembly.

In still another embodiment, both the upper and lower surfaces of the paper mailer stock are overlaminated with the same adhesive/polyester material in an area larger than the die-cut area.

Variations of the above described embodiments are also described herein, utilizing different compositions for either the backing or overlaminate materials or both.

Accordingly, in its broader aspects, the invention relates to a pressure seal mailer assembly compatible with non-impact printing techniques, wherein the mailer assembly includes paper stock with a plurality of interconnected and foldable panels and pressure activated adhesive along plural edges thereof, the improvement comprising at least one opening in one of said panels and a removable card located and releasably held within the opening; and a laminate assembly applied to one side of the paper stock covering at least the opening therein, and wherein part of the laminate assembly remains with the at least one removable card when removed from the paper stock.

In another aspect, the invention relates to a pressure seal mailer comprising a sheet of paper stock having at least three foldable panels, two of which form exterior panels and one of which form an interior panel; the interior panel having at least one card incorporated within an opening in the interior panel to thereby maintain a substantially uniform thickness across the interior panel; and a laminate assembly applied to the underside of the interior panel overlying and extending beyond the opening.

Other objects and advantages of the present invention will become apparent from the detailed description that follows.

DETAILED DESCRIPTION OF THE DRAWINGS

Figure 1:
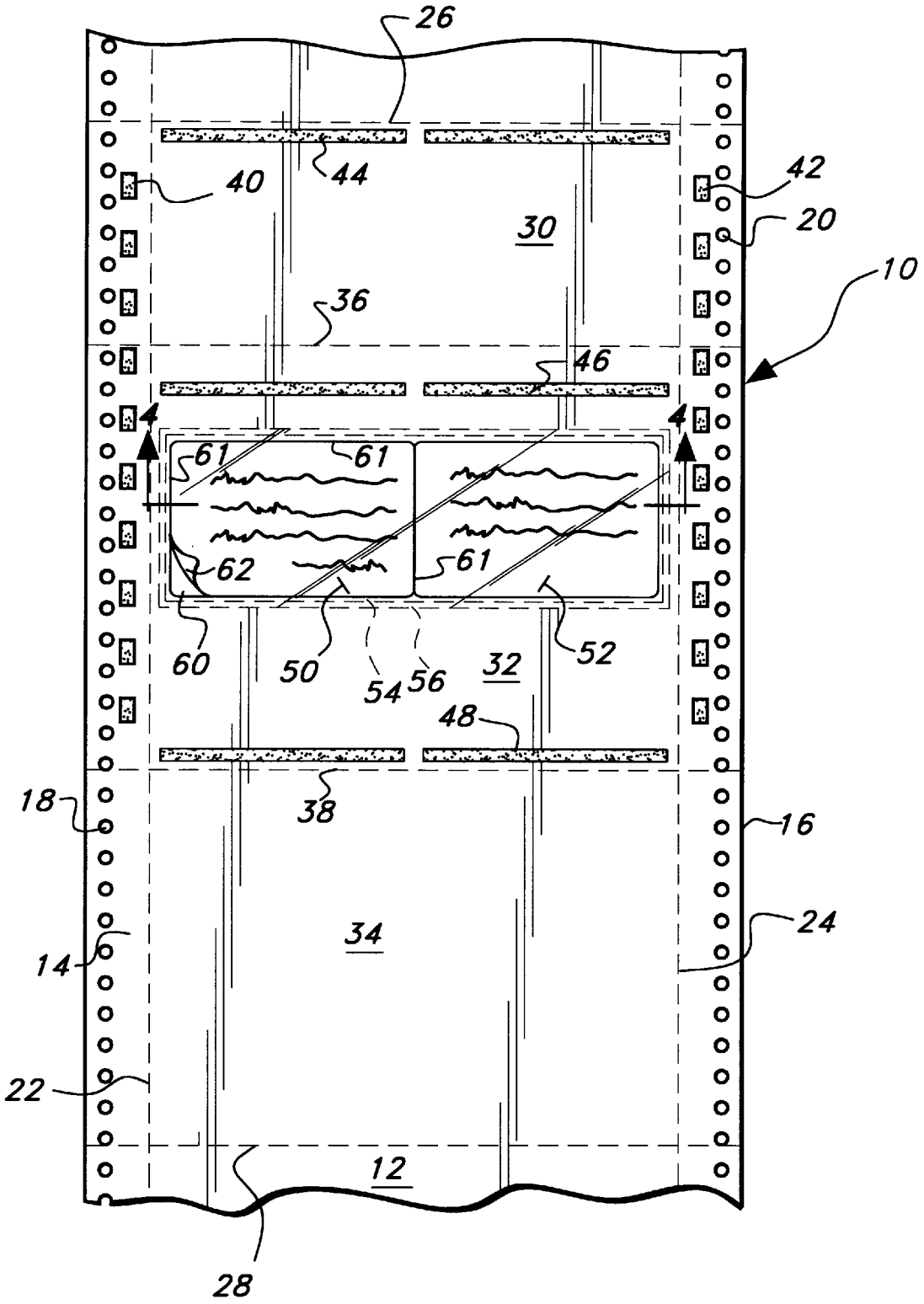
FIG. 1 is a partial plan view of a continuous paper stock incorporating a pressure seal mailer in accordance with an exemplary embodiment of the invention.

FIG. 1 illustrates components of the mailer assembly 10 in a manufacturing process. Specifically, the form assembly is shown as part of a continuous paper stock web 12 which includes removable marginal edge strips 14, 16 containing respective tractor feed holes 18, 20, the edge strips defined by longitudinally extending perf lines 22, 24. Within the continuous paper stock web, individual form assemblies are connected by transverse perf lines—for example, the assembly 10 is defined by perf lines 26, 28. The form assembly 10 includes panels 30, 32 and 34 which are separated by additional longitudinally spaced, transverse perf lines 36, 38. It will be understood, of course, that assembly 10 can be produced in a non-continuous manner, i.e., in cut sheet form, where panels 30, 32 and 34 comprise a single, discreet sheet. The paper stock is conventional paper material used in mailer assemblies.

The mailer assembly 10 also includes pressure sensitive adhesive dots and lines which enable the mailer to be folded and sealed in a conventional manner after the form has been non-impact printed, as by a laser printer. More specifically, conventional, permanent pressure sensitive adhesive spots

40, 42 are located within respective marginal strips 14, 16 while transversely oriented pairs of adhesive lines 44, 46, 48 are located along transverse edges of the panels 30 and 32. The adhesive orientation is exemplary only, and many variations are possible and within the scope of this invention, depending on the exact configuration of the mailer.

Figure 2:
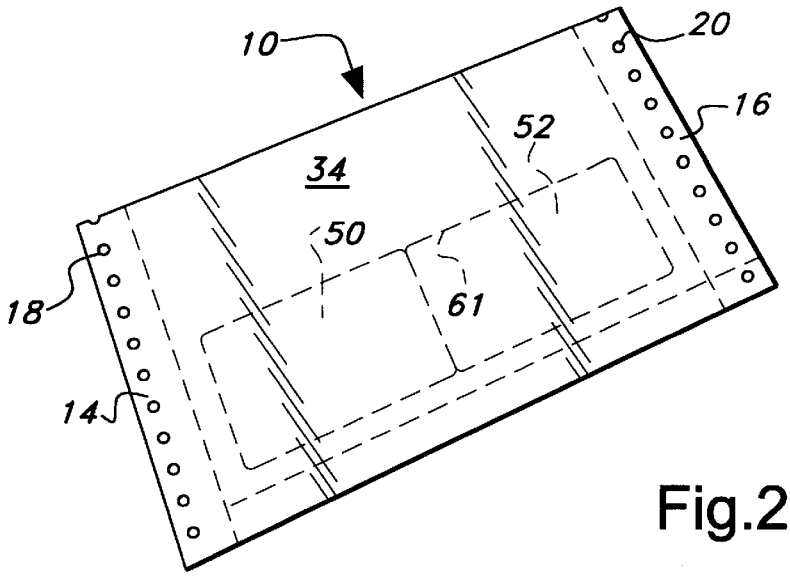
FIG. 2 is a perspective view of a folded pressure seal mailer in accordance with the invention.

In the context of a regular Z-fold mailer, it will be appreciated that panels 30 and 34 sandwich the panel 32 therebetween (see finished assembly 10 in FIG. 2), and therefore it is the "interior" panel 32 which integrates a pair of cards 50, 52 in accordance with one example of the invention. In regular Z-fold mailers, the three panels 30, 32 and 34 are of substantially the same size, while in eccentric Z-fold mailers, one of the exterior (when folded) panels is smaller (see panel 30 in FIG. 1). The invention here is equally applicable to various form/fold arrangements.

Figure 3A:
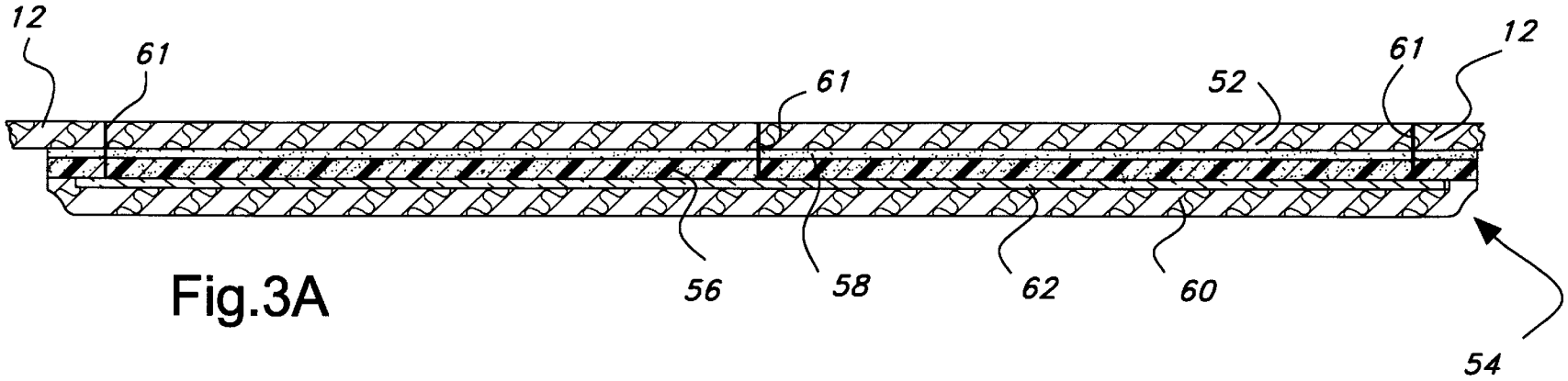
FIG. 3A is a partial cross section through a pressure seal mailer as shown in FIG. 1.

With reference now to the schematic diagrams of FIGS. 3A–3B, and various card integration techniques in accordance with the invention will be described. The thicknesses of the various components are not drawn to scale, and are enlarged for the sake of clarity. In this regard, one of the features of the invention is that the mailer is not appreciably increased in thickness by the card construction. The schematic in FIG. 3A represents a transverse section through the panel 32 of FIG. 1. In this embodiment, the underside of the paper stock web 12 is provided on its underside with a laminate assembly 54 which is commercially available under the name "Lite-Lift Dry" available from Precision Coated Products of Batevia, Ill. Other laminate constructions may be suitable as well.

The assembly 54 includes a ½ mil to 5 mil polyester film 56 with a permanent adhesive 58 on its top surface (protected during shipping with a disposable liner, not shown). This film adds a degree of stiffness and durability to the cards 50, 52. Below the polyester film is a 25–50 lb. translucent or transparent paper base liner or backing patch 60 top coated with a suitable varnish 62 which "attracts" or temporarily adheres to the polyester film 56. This results in the cards 50, 52 remaining temporarily adhered to the mailer even after die cutting which extends down through the paper stock 12 and through the polyester film 56.

The laminate assembly extends about ¼ inch beyond the area to be die cut on all sides of the card or cards. In the exemplary embodiment, the varnish top coat 62 may terminate short of the edges of the base liner or backing patch 60 so that the latter will adhere directly to the polyester film 56 about a peripheral border thereof, i.e., outside the card or cards.

The die-cut indicated at 61 and which defines the boundaries of the cards 50, 52 can be carried out using a flex plate or roto cylinder.

Figure 5:
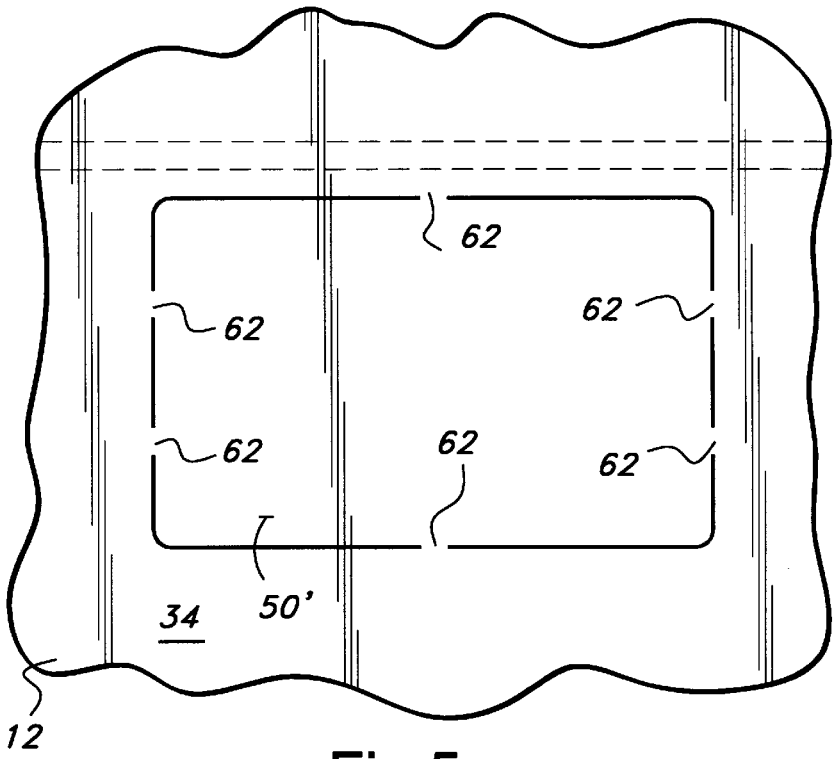
FIG. 5 is a partial plan view of a panel of a pressure seal mailer in accordance with the invention, illustrating a particular die-cut arrangement.

If desired, the die-cut can be intermittent, leaving ties or uncut areas 63 as shown in card 50' in FIG. 5. In either case, the card is easily removed by the addressee by peeling the card away from the form, leaving the base liner or backing patch in place.

Figure 3B:
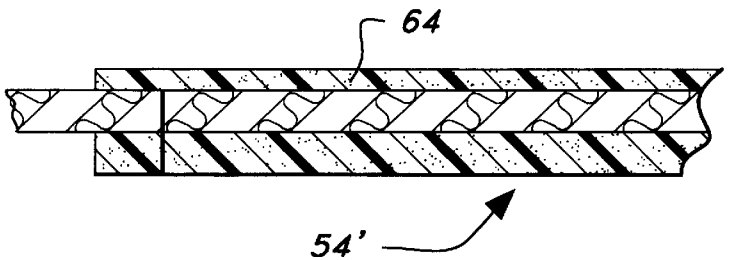
FIG. 3B is a partial section through a pressure seal mailer in accordance with a second embodiment of the invention.

Turning to FIG. 3B, another embodiment is illustrated where the laminate assembly 54 (shown only generally instead of by layer) is as described above, but an overlaminate 64 is added to the upper surface of the paper stock, over an area which is approximately the same as the laminate assembly 54'. The overlaminate 64 is a clear or matte (about ½ to 5 mil in thickness) top coat of laser and signature compatible polyester or polyvin material, adhesively secured to the paper stock. The overlaminate 64, like the polyester film 56, adds rigidity, i.e., stiffness, and durability to the card construction.

Figure 4:
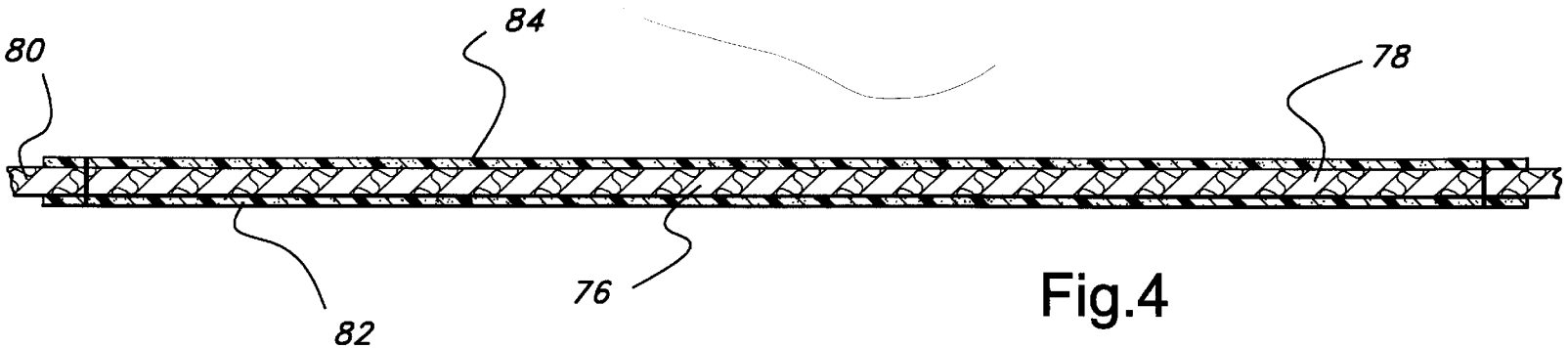
FIG. 4 is a partial cross section through a pressure seal mailer in accordance with another exemplary embodiment of the invention.

In FIG. 4, card 76,78 are also formed directly from the paper stock 80 A polyester or polyvin backing patch 82 is adhesively secured to the underside of the paper stock including the die-cut cards, while a similar polyester or polyvin overlaminate 84 is adhesively secured to the upper surface of the paper stock including the cards. The adhesive layers are not shown but are similar to layer 58 described above. The die cut will extend through the paper stock 80 and both polyester or polyvin film layers 84,82 In this arrangement, it is necessary to use ties or uncut areas such as those shown at 62 in FIG. 5 to hold the cards within the form.

Figure 6:
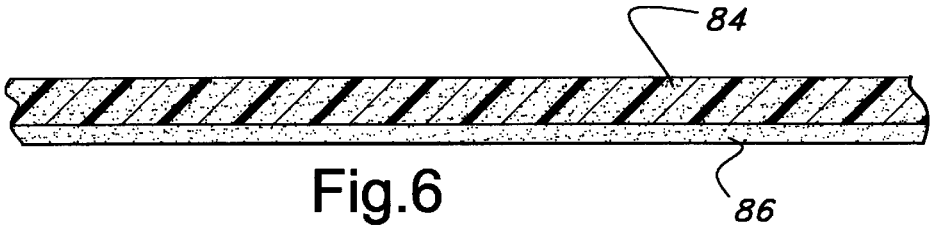
FIG. 6 is an enlarged cross section showing the adhesive film on an overlaminate in accordance with the invention.

It should also be noted here that the various sections shown in FIGS. 3A–3D and 4 omit, for simplicity sake, the adhesive used to secure the polyester films to the paper stock. FIG. 6 shows the polyester or polyvin film overlaminate 84 with a thin adhesive layer 86 by which the film 84 is secured to the paper stock 80.

In all cases, the incorporation of a laminate assembly or discrete films on upper and lower surface of the paper stock does not require the mailer to be calendared in order to pressure seal the edges of the mailer.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a pressure seal mailer assembly compatible with non-impact printing techniques, wherein the mailer assembly includes paper stock with a plurality of interconnected and foldable panels and pressure activated adhesive along plural edges thereof, the improvement comprising:

at least one opening in one of said panels and at least one removable card located and releasably held within the opening; wherein a laminate assembly comprising at least two components is applied to one side of the paper stock covering at least the opening therein, and further wherein part of the laminate assembly remains with the at least one removable card when removed from the paper stock; and wherein one of said at least two components of said laminate assembly includes a film layer adhesively secured to an underside of said at least one panel; and another of said at least two components of said laminate assembly includes a backing patch which is temporarily and removably adhered to said film layer.

2. The improvement of claim 1 wherein said backing patch is paper and said film layer is polyester.

3. The improvement of claim 1 wherein said backing patch is paper and said film layer is polyvin.

4. A pressure seal mailer comprising:

a sheet of paper stock having at least three foldable panels, two of which form exterior panels and one of which form an interior panel; said internal panel having at least one card incorporated within an opening in said interior panel to thereby maintain a substantially uniform thickness across the interior panel; and a laminate assembly comprising at least two components applied to the underside of the interior panel overlying and extending beyond said openings, wherein one of said at least two components of said laminate assembly includes a polyester or polyvin film adhesively secured to an underside of said paper stock, and another of said at least two components of said laminate assembly includes a base liner or backing patch top coated with a varnish.

5. The pressure seal mailer of claim 4 wherein at least two of said panels have pressure sensitive adhesive applied thereto.

6. The pressure seal mailer of claim 4 including a second card in addition to said at least one card.

* * * * *